US005113567A

United States Patent [19]

Yunoki

[11] Patent Number: 5,113,567

[45] Date of Patent: May 19, 1992

[54] METHOD OF AND APPARATUS FOR FEEDING AN ARRAY OF SLIDERS

[75] Inventor: Akio Yunoki, Namerikawa, Japan

[73] Assignee: Yoshida Kogyo K. K., Tokyo, Japan

[21] Appl. No.: 741,732

[22] Filed: Aug. 7, 1991

[30] Foreign Application Priority Data

Aug. 8, 1990 [JP] Japan ..... 2-210590
Apr. 11, 1991 [JP] Japan ..... 3-108763

[51] Int. Cl.[5] ..... A41H 37/06
[52] U.S. Cl. ..... 29/408; 29/768
[58] Field of Search ..... 29/409, 768, 408

[56] References Cited

U.S. PATENT DOCUMENTS 3,629,926 12/1971 Maeda ..... 29/768
3,644,981 2/1972 Gustavasson .
4,049,155 9/1977 Kawakami et al. ..... 29/768
4,466,168 8/1984 Hatagishi .
4,782,587 11/1988 Yunoki .
4,809,414 3/1989 Sawada ..... 29/768
4,974,315 12/1990 Yunoki .
5,025,544 6/1991 Yoneda et al. ..... 29/409

FOREIGN PATENT DOCUMENTS 54-35762 10/1979 Japan .
63-11104 1/1988 Japan .

*Primary Examiner*—P. W. Echols
*Attorney, Agent, or Firm*—Hill, Van Santen, Steadman & Simpson

[57] ABSTRACT

A method of feeding an array of sliders one at a time for application onto a stringer chain is disclosed, which method comprises holding the array of slider linearly in a tilted position relative to a horizontal path of travel of the stringer chain so that the sliders can slide down smoothly by gravity, orienting a leading slider to lie flush with the horizontal path of the chain and transferring the leading slider over to a slider applying station. An apparatus is also disclosed for carrying this method into practice.

4 Claims, 6 Drawing Sheets

METHOD OF AND APPARATUS FOR FEEDING AN ARRAY OF SLIDERS

BACKGROUND OF THE INVENTION

1. Field of the Invention

This invention relates to a method of and an apparatus for feeding sliders to be mounted on slide fastener stringers. More specifically, the invention is directed to a method and apparatus for transferring an array of sliders one at a time from a supply chute onto a slider applying holder adapted to apply the sliders manually or automatically to a stringer chain in the process of manufacture of slide fastener products.

2. Prior Art

Conventional apparatus for supplying and transferring a series of sliders one at a time to a slide fastener stringer chain generally comprise an elongate supply chute extending from a parts feeder or hopper, a slider applying holder adapted to assemble the stringer chain with sliders at predetermined intervals therealong and a transfer means of transferring the sliders one at a time from the supply chute to the slider applying holder. Certain typical Japanese Utility Model Publication 54-35762 and (B) Japanese Laid-Open Patent Publication 63-11104, in which sliders in a row supplied from a parts feeder are advanced by sliding movement on and along an elongate supply chute having a substantially vertical straight portion extending from the outlet of the parts feeder, a downwardly arcuate portion and a substantially horizontal terminal portion at which a leading one of the sliders is forced out for transfer onto a slider applying holder. The supply chute in the prior art (A) is directly connected to the applying holder, while a slider transfer means is interposed between the chute and the holder according to the prior art (B). In either case, the sliders are fed by aggregated gravity along the supply chute and hence would often get sluggish or stuck particularly at the arcuate run of the chute, with the result that those sliders on the horizontal run of the chute fail to move forward to the outlet of the chute, leading to interrupted or discontinued supply to the applying holder.

SUMMARY OF THE INVENTION

With the foregoing difficulties of the prior art in view, the present invention seeks to provide an improved method and apparatus for feeding a row of sliders along a downwardly tilted path of movement and transferring them one at a time in horizontal orientation for application onto a stringer chain with a maximum of efficiency and accuracy and without involving the risk of interrupted feeding operation.

A method of feeding an array of sliders according to the invention comprises the steps of: holding the array of sliders linearly in a tilted position at an acute angle relative to a horizontal path of travel of the stringer chain; receiving a leading slider while held in the tilted position and orienting the same to lie flush with the horizontal path of the stringer chain; and moving the leading slider horizontally forward and transferring the same to a slider applying station for application onto the stringer chain.

An apparatus for carrying the above method into practice comprises: a slider supply chute extending linearly in a tilted position at an acute angle relative to a horizontal path of travel of the stringer chain; a slider applying holder having a primary nest for receiving a leading slider for application onto the stringer chain; and a transfer carriage unit movable reciprocally horizontally toward and away from the holder and having an arm pivotally connected thereto and a head extending horizontally from the arm, the head having a secondary nest for receiving the sliders one at a time from the chute, the arm being rotatable between a first position in which the secondary nest is held in registry with the chute and a second position in which the second nest is oriented horizontally to lie flush with the first nest.

The above and other features and advantages of the invention will appear manifest from reading the following detailed description taken in conjunction with the accompanying drawings.

DETAILED DESCRIPTION OF THE INVENTION

Figure 5:
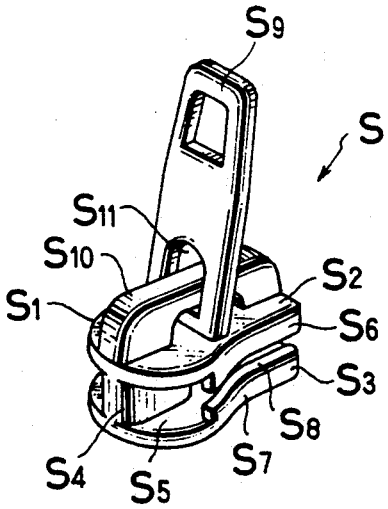
FIG. 5 is a perspective view of an example of slide fastener slider which may be fed and applied according to the invention.

Referring now to the drawings and firstly to FIG. 5, there is shown a typical example of slider for slide fastener which may be handled by the apparatus of the invention, the slider designated generally at S comprising a slider body $S_1$ having an upper wing member $S_2$ and a lower wing member $S_3$ interconnected at one end by a neck or "diamond" $S_4$ to define therebetween a guide channel $S_5$ for the passage of a stringer chain. The upper and lower wing members $S_2$, $S_3$ have their respective lateral flanges $S_6$, $S_7$ inwardly directed in confrontation across a gap $S_8$. A pull tab $S_9$ is pivotally supported on a trunnion $S_{10}$ through an opening $S_{11}$.

Figure 1:
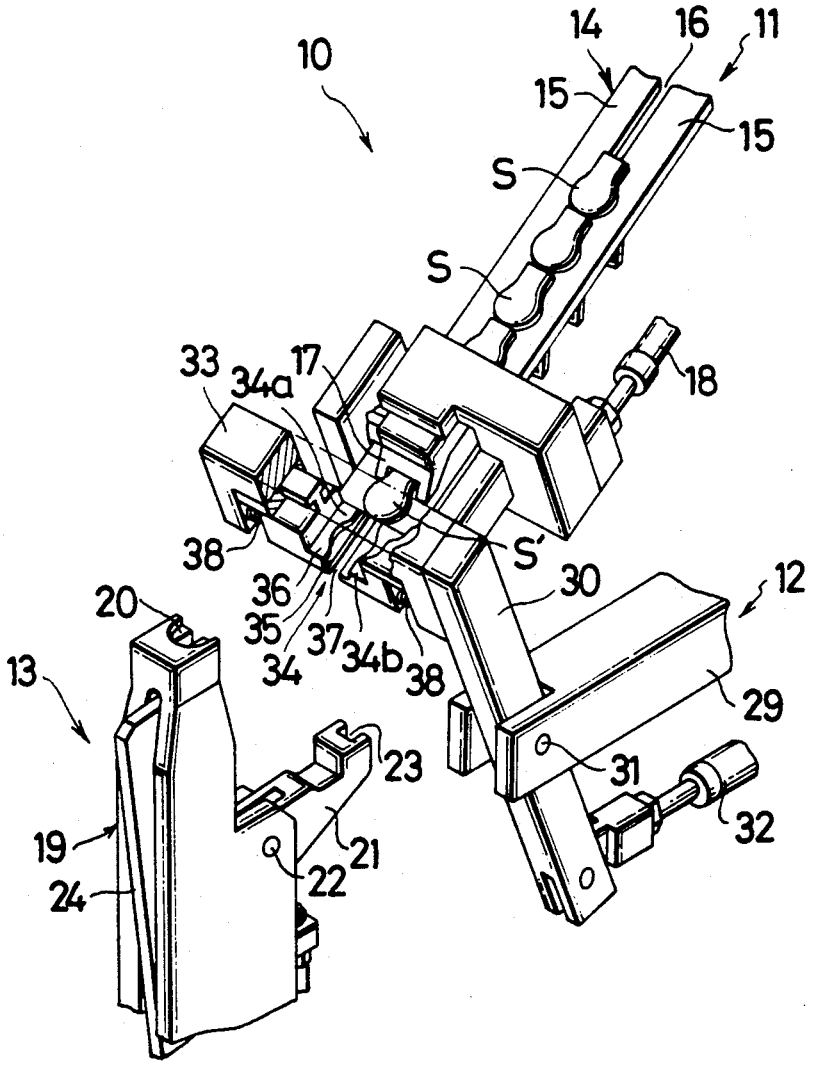
FIG. 1 is a perspective view of an apparatus embodying the invention.

Now, turning to FIG. 1 there is shown a general construction of the apparatus of the invention for feeding the sliders S in a row, which apparatus designated at 10 generally comprises a slider supply chute unit 11, a transfer carriage unit 12 and a slider applying holder unit 13.

Figure 2:
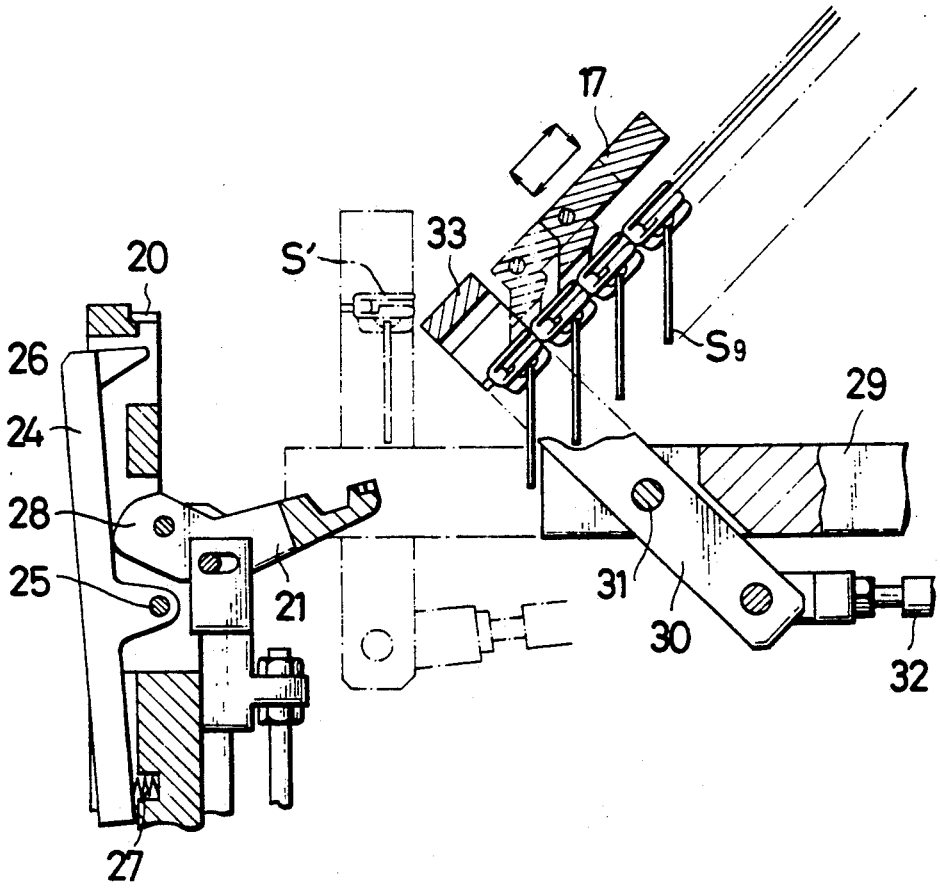
FIG. 2 is a side elevational, partly sectional view of the apparatus showing the same in one stage of operation.
Figure 3:
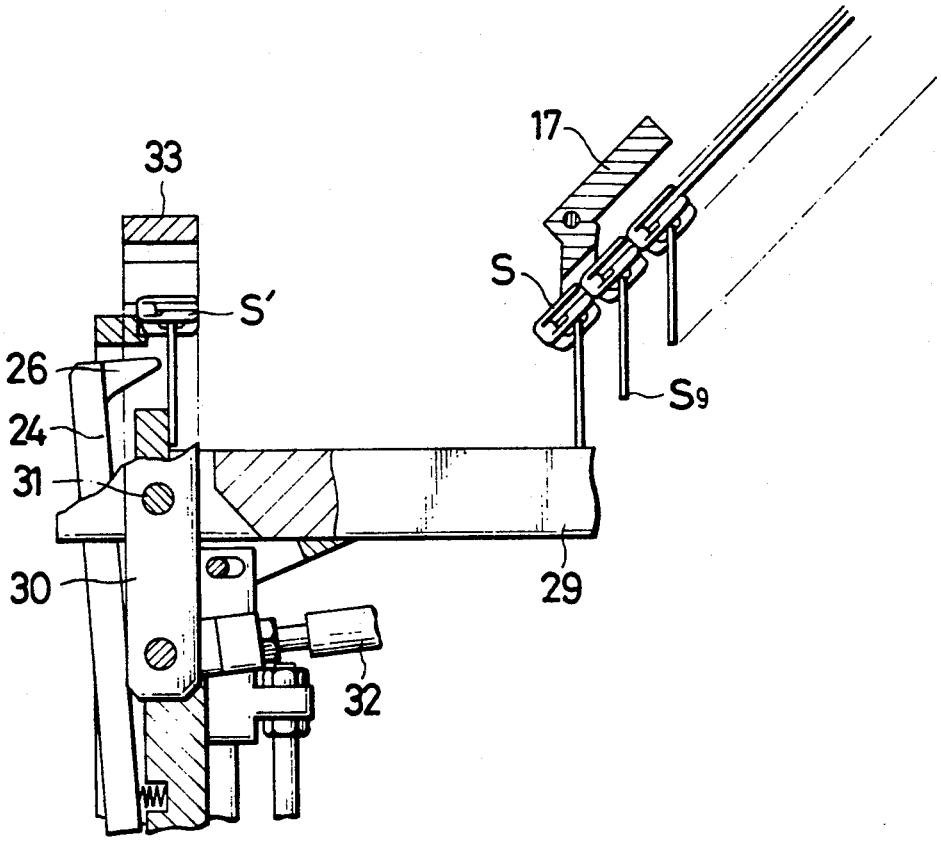
FIG. 3 is a view similar to FIG. 2 but showing the apparatus in another stage of operation.

The chute unit 11 comprises a chute 14 formed from a pair of elongate plates 15, 15 disposed in parallel longitudinally spaced relation and defining therebetween a longitudinal guide slit 16 through which the sliders S are mounted upside down with their pull tabs $S_9$ hung down as better shown in FIGS. 2 and 3. The chute 14 has one of its ends connected to a parts feeder or hopper not shown having a supply inventory of sliders S and the opposite end free and open so as to allow the sliders S to be transported by the transfer carriage unit 12 over to the holder unit 13 in a manner hereinafter to be described. At the other end or outlet of the chute 14 is provided a means not shown for arresting the sliders S lest the latter should fall out from the chute 14. According to a feature of the invention, the chute 14 is disposed at an acute angle relative to the horizontal path of travel of a stringer chain F and extends linearly throughout its length so that the sliders S are allowed to move smoothly downward by their gravity.

Designated at 17 is a pusher adapted to urge a leading slider S' at the leading end of the row of sliders S to move onto the transfer carriage unit 12 as shown in FIG. 2. The pusher 17 is actuated by a drive cylinder 18 to move in the directions of the arrows indicated in FIG. 2, first downwardly to engage the leading slider S', forwardly taking the leading slider S' toward the carriage 12, upwardly apart from the path of the sliders S, and finally backwardly to the initial position at which the pusher 17 stands by for the next cycle of operation, the polydirectional movements of the pusher 17 being controlled by a suitable cam mechanism as is well known. The pusher 17 may be of other types and construction as appears obvious to one skilled in the art and will need no further explanation as it forms no positive part of the invention.

Figure 4:
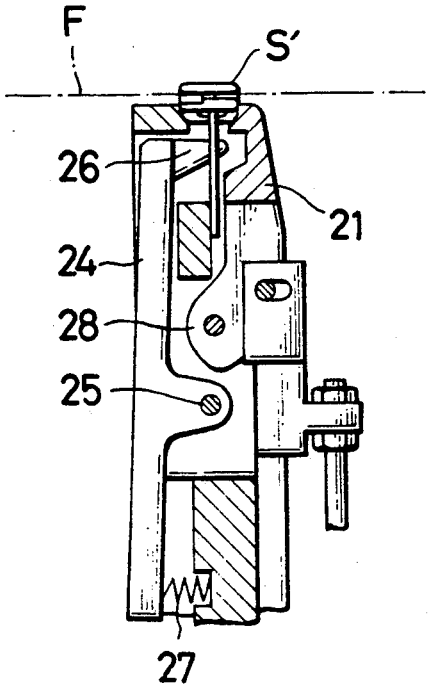
FIG. 4 is a slider applying holder forming part of the apparatus.

The slider applying holder unit 13 has a vertically disposed support frame 19 having a primary nest consisting of a first recess or nest 20 formed in its top surface for receiving a front half portion of the sliders S' and a pivotal arm 21 pivotally connected at one end by pin 22 to the frame 19 and having a second recess or nest 23 at the opposite free end for receiving a rear half portion of the slider S'. A piston rod extending from a drive cylinder not shown is adapted to move the arm 21 pivotally toward and away from the frame 19 as shown in FIG. 4. The holder unit 13 further includes an engaging lever 24 pivotally connected by pin 25 to the frame 19 and having a pawl 26 at its upper end for engaging in the opening $S_{11}$ of the slider pull tab $S_9$ and connected at its lower end to a spring 27 secured to the frame 19 as shown FIG. 4. Formed at the lower end of the arm 21 is a cam 28 engageable with the lever 24 adjacent the pivot 25 thereof when the arm 21 is flipped upward to bring the second nest 23 up in alignment with the first nest 20 of the frame 19 as shown in FIG. 4, in which instance the pawl 26 is urged by the action of the spring 27 further into the opening $S_{11}$ of the pull tab $S_9$, causing the slider S' to sink and get firmly anchored in a pocket defined by the first and second nests 20, 23, as better shown in FIG. 4.

The transfer carriage unit 12 comprises a horizontally disposed carriage 29 and a crank arm 30 pivotally connected thereto by pin 31. The carriage 29 is movable reciprocally horizontally by means such as a drive cylinder not shown.

The arm 30 is connected at one end to a piston rod 32 extending from a drive cylinder not shown and is rotatable clockwise as viewed in the drawing into the upright position indicated by phantom line in FIG. 2 as the carriage 29 advances toward the slide applying holder 13. Extending horizontally from the opposite end of the crank arm 30 is a transverse head 33 which is recessed to provide a secondary nest 34 for receiving the leading slider S' from the chute 14 as better shown in FIG. 1. The nest 34 is divided by a slit 37 longitudinally into identical halves 34*a* and 34*b* which are formed by a first pair of side walls 35, 35 of a reduced thickness such that the walls 35, 35 can be inserted through the gaps $S_8$ into the guide channel $S_5$ of the slider S and by a second pair of side walls 36, 36 of an increased thickness such that the walls 36, 36 fit peripherally around the lower wing member $S_3$ of the slider S. The slit 37 is registrable in position with the guide slit 16 of the chute 14 when the crank arm 30 is brought into a tilted position at right angles to the general plane of the chute 14 at which to receive the leading slider S' as shown in FIGS. 1 and 2. A pair of oppositely disposed springs 38, 38 are provided to normally urge the nest halves 34*a*, 34*b* toward each other across the slit 37 so as to retain the slider S' securely in place during transfer thereof onto the slider applying holder unit 13.

A stringer chain F schematically shown in FIG. 4 has spaced gaps (not shown) at predetermined intervals along its length, the gaps being utilized for mounting the sliders S in a manner well known in the art. The chain F is introduced along the path of movement into a slider applying station. The stringer chain F is stopped when each of the gaps is located at the slider applying holder 13. The leading or endmost slider S' at the outlet of the chute 14 is moved forward by the pusher 17 into the nest 34 in the head 33 of the crank arm 30, urging the halves 34*a*, 34*b* of the nest 34 apart against the tension of the springs 38, 38. The pusher 17 is retracted, releasing the slider S' held in the nest 34 as shown in FIG. 2. This is followed by advancing movement of the carriage 29 toward the slider applying holder 13, when the crank arm 30 rotates clockwise until it assumes the upright position indicated by phantom line with the slider S' in the nest 34 oriented to lie flush in line with the nests 20 (23) of the holder 13, as shown in FIG. 2. The carriage 29 is further moved forward until the slider S' reaches and has its front half portion engaged in the first half nest 20 in the holder 13. Then, the carriage 29 is held to a stop, followed by pivotal movement of the arm 21 of the holder 13 from the position in FIG. 2 to the position in FIG. 4 in which the second half nest 23 engages with the rear half portion of the slider S' and at the same time, the pawl 26 of the lever 24 enters into the opening $S_{11}$ of the pull tab $S_9$ and is urged downwardly by the action of the spring 27 thereby firmly anchoring the slider S' in the nests 20, 23 as shown in FIG. 4. With the slider S' thus firmly anchored in place, the carriage 29 is now retracted away from the holder 13, when the nest 34 in the head 33 is allowed to open apart, leaving the slider S' in the nests 20, 23 of the holder 13. During the retractive movement of the carriage 29, the head 33 rotates counterclockwise to assume the original tilted position in which the nest 34 is oriented to lie in alignment with the chute 14 and thus is ready for receiving a next leading one of sliders S in a row, as shown in FIG. 2.

Figure 6:
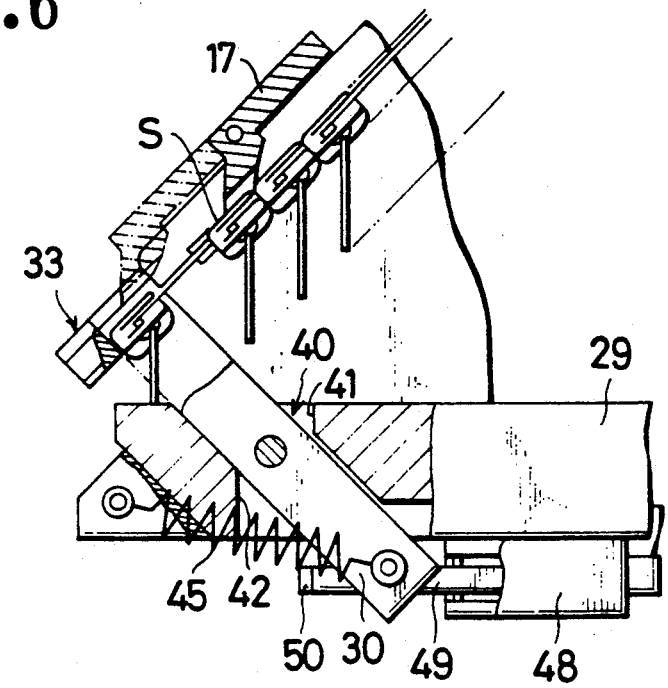
FIG. 6 is a side elevational, partly sectional view of a modified form of apparatus embodying the invention, showing the same in one stage of operation.
Figure 7:
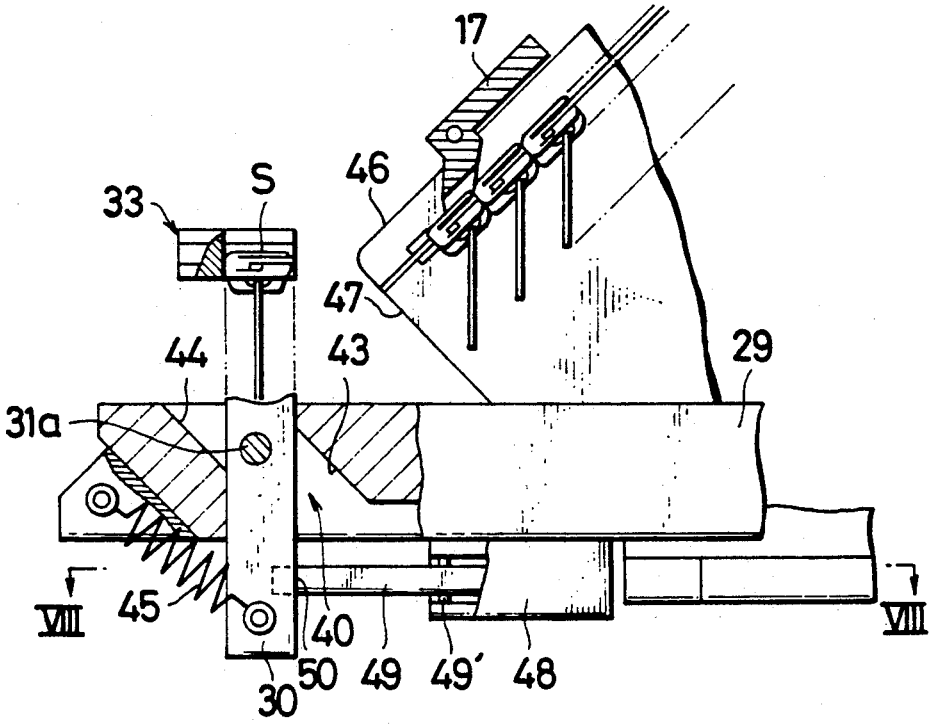
FIG. 7 is a view similar to FIG. 6 but showing the apparatus in another stage of operation.

There is shown a modified form of transfer carriage unit 12 in which the arm 30 is rotatably mounted about a support pin 31*a* extending transversely through a polygonal aperture 40 formed in the carriage 29. The polygonal aperture 40 is defined by two vertically straight walls 41, 42 for abutting engagement with the arm 30, the walls 41, 42 being spaced in parallel relation by a distance substantially equal to the width of the arm 30 such that the arm 30 when rotated into the upright position can be retained firmly in place as shown in FIG. 7. The aperture 40 is further defined by two slanted straight walls 43, 44 merging with the vertical walls 41, 42 respectively and disposed for abutting engagement with the arm 30, the walls 43, 44 being spaced in parallel relation by a distance substantially equal to the width of the arm 30 such that the arm when rotated into the slanted or inclined position can be retained firmly in place as shown in FIG. 6. A tension spring 45 is provided to normally urge the arm 30 in a direction to retain its upright position. A support block 46 is provided at the lower or outlet end of the chute 14 and has a front endwall 47 extending in parallel relation to the slanted inner walls 43, 44 of the carriage 29 for abutting engagement with the arm 30 to orient and retain the latter in the slanted position as shown in FIG. 6.

Figure 8:
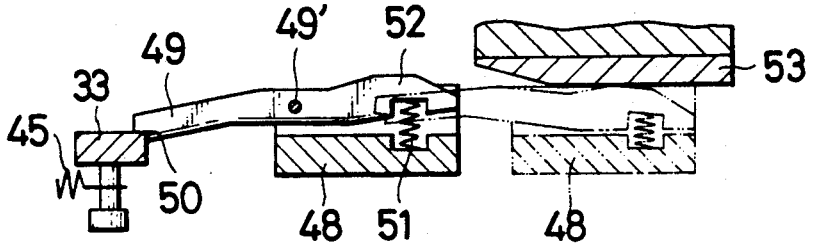
FIG. 8 is a cross-sectional view taken on the line VIII—VIII of FIG. 7.

A bracket 48 secured to the bottom of the carriage 29 is provided with a horizontally extending lever 49 which is pivotally connected to a pin 49' to move in a horizontal plane and which has at one of its ends a hook 50 normally biased by a spring 51 to engage with and retain the arm 30 in the upright position. At the opposite end of the lever 49 is formed a swollen or raised portion 52 which is engageable with a retainer plate 53 in the carriage 29 as shown in FIG. 8. As the lever 49 is retracted with the carriage 29 to bring the arm 30 into the slanted position (FIG. 6), the swollen portion 52 and the retainer plate 53 cooperate to urge the lever 49 to rotate against the tension of the spring 51 in a direction to release the hook 50 from the arm 30.

Figure 9:
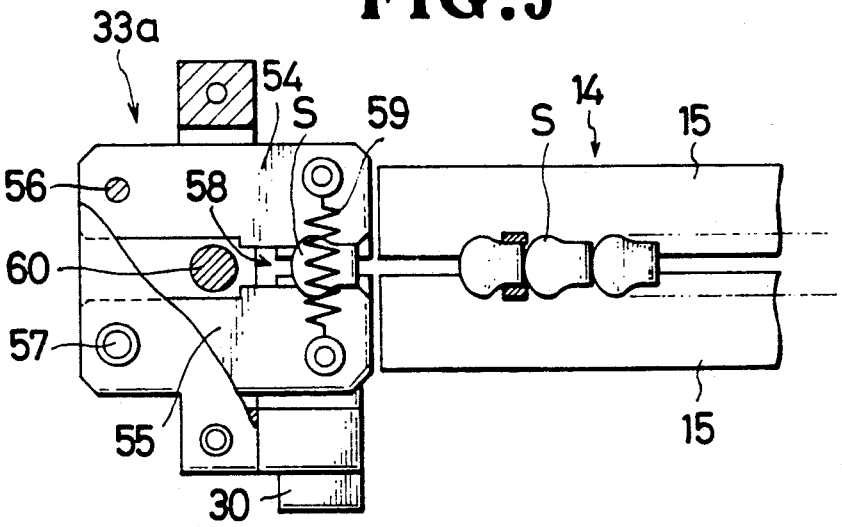
FIG. 9 is a plan view of a modified part of the apparatus.
Figure 10:
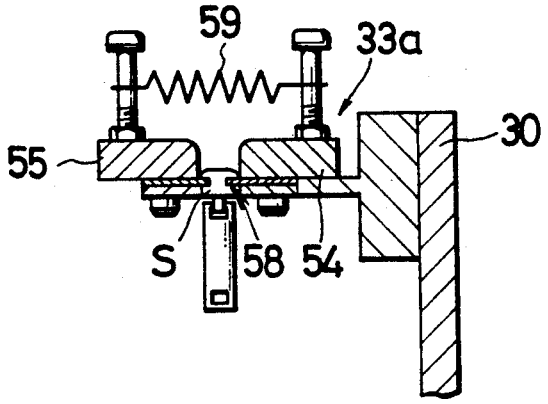
FIG. 10 is a sectional view of part of the apparatus of FIG. 9.

FIGS. 9 and 10 show a modified head 33*a* of the arm 30 which comprises a pair of spaced fingers 54 and 55 pivotally mounted at one of their ends about their respective pins 56, 57 and provided with a slider receiving nest 58 similar to the nest 34 at the opposite end confronting the outlet of the chute 14. The pair of fingers 54 and 55 are normally urged toward each other at the nest 58 by a spring 59 to an extent limited by a spacer 60 centrally mounted in the head 33*a*.

Obviously, various modifications and variations of the present invention are possible in the light of the above teaching. It is therefore to be understood that within the scope of the appended claims the invention may be practiced otherwise than as specifically described.

What is claimed is:

1. A method of feeding an array of sliders one at a time for application onto a stringer chain which comprises the steps of:

(a) holding said array of sliders linearly in a tilted position at an acute angle relative to a horizontal path of travel of said stringer chain;

(b) receiving a leading slider while held in said tilted position and orienting the same to lie flush with said horizontal path of said stringer chain; and (c) moving said leading slider horizontally forward and transferring the same to a slider applying station for application onto said stringer chain.

2. An apparatus for feeding an array of sliders one at a time for application onto a stringer chain which comprises:

(i) a slider supply chute extending linearly in a tilted position at an acute angle relative to a horizontal path of travel of said stringer chain;

(ii) a slider applying holder having a primary nest for receiving a leading slider for application onto said stringer chain; and (iii) a transfer carriage unit movable reciprocally horizontally toward and away from said holder and having an arm pivotally connected thereto and a head extending horizontally from said arm, said head having a secondary nest for receiving said sliders one at a time from said chute, said arm being rotatable between a first position in which said secondary nest is held in registry with said chute and a second position in which said secondary nest is oriented horizontally to lie flush with said primary nest.

3. An apparatus according to claim 2 wherein said secondary nest is divided into identical halves which are normally urged toward each other.

4. An apparatus according to claim 2 wherein said carriage unit is provided with a polygonal aperture defined by two vertically straight walls disposed for abutting engagement with said arm and spaced in parallel relation by a distance substantially equal to the width of said arm such that said arm is retained firmly in said second position and further defined by two slanted straight walls disposed for abutting engagement with said arm and spaced in parallel relation by a distance substantially equal to the width of said arm such that said arm is retained firmly in said first position.

* * * * *